US006890061B1

(12) United States Patent
Freire et al.

(10) Patent No.: US 6,890,061 B1
(45) Date of Patent: May 10, 2005

(54) COMPACT FULL-WIDTH ARRAY ARCHITECTURE WITHOUT SATELLITE AND BUTTING ERRORS

(75) Inventors: Eduardo Mariano Freire, Webster, NY (US); Harry Anderson Williams, Webster, NY (US); Gary A. Kneezel, Webster, NY (US); Yoshihiko Fujimura, Fujisawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/735,663

(22) Filed: Dec. 16, 2003

(51) Int. Cl.[7] ..... B41J 2/155
(52) U.S. Cl. ..... 347/42; 347/13; 347/43
(58) Field of Search ..... 347/13, 15, 43, 347/42, 12, 40

(56) References Cited

U.S. PATENT DOCUMENTS 4,999,077 A 3/1991 Drake et al.
5,192,959 A 3/1993 Drake et al.
5,198,054 A 3/1993 Drake et al.
5,257,043 A 10/1993 Kneezel
5,270,738 A 12/1993 Takahashi et al.
5,280,308 A 1/1994 Takahashi et al.
5,343,227 A 8/1994 Hirosawa et al.
6,352,329 B1 * 3/2002 Watanabe et al. ..... 347/15

* cited by examiner

*Primary Examiner*—Lamson Nguyen
(74) *Attorney, Agent, or Firm*—Oliff & Berridge, PLC

(57) ABSTRACT

A printer with reduced required space for printbar substrates in a printhead is disclosed. A first printbar has of a plurality of first die modules, for applying a first color, spaced apart so as to have gaps between each die module and located on a top surface of a first substrate. A second printbar has of a plurality of second die modules, for applying a second color, different for the first color, spaced apart so as to have gaps between each die module and located on a bottom surface of the first substrate. A third printbar for applying the first color and a fourth printbar for applying the second color, both have die modules, spaced apart on a top surface and a bottom surface of a second substrate, that correspond with the gaps on the top surface and the bottom surface of the first substrate, respectively.

20 Claims, 8 Drawing Sheets

COMPACT FULL-WIDTH ARRAY ARCHITECTURE WITHOUT SATELLITE AND BUTTING ERRORS

BACKGROUND OF THE INVENTION

1. Field of Invention

This invention relates to a staggered full-width array printing system, and particularly to a set of staggered full-width array printbars comprised of die modules and more particularly to a first printbar comprised of a plurality of first die modules, for applying a first color, spaced substantially evenly apart so as to have gaps between each die module and located on a top surface of a first substrate, and a second printbar comprised of a plurality of second die modules, for applying a second color, different from the first color, spaced substantially evenly apart so as to have gaps between each die module and located on a bottom surface of the first substrate.

2. Description of Related Art

In an ink jet printing apparatus, individual drops of ink are ejected from a nozzle such that the droplet of ink travels under its own momentum towards a sheet of paper or other print medium on which drops of ink are intended to fall, with the impact areas overlapping so that they form characters or other marks of desired shape. In the ink jet printing apparatus, a printhead including a printbar with several die modules may be used with a plurality of individual nozzles in which to dispel the ink droplets. Such printheads are scanned across the medium to be marked in order to print the entire page.

Alternatively, with a page-width printhead, the printhead is stationary and dispels ink onto the medium from the top of the medium to the bottom. With a page-width printhead, the printhead will include a full-width printbar with several die modules accurately positioned with respect to each other so that the line of picture elements (pixels) produced by printed droplets from neighboring modules show no seams, and the pixels appear to be produced by one continuous line of uniformly spaced ink drop nozzles. An ink may be deposited onto the print medium one line at a time by the full-width printbar as the paper passes by until full-page images are completed. This type of ink jet printing process uses a single pass method and is known as a "full-width array" printer.

Various methods are known for fabricating full-width array printbars. One method is to form a linear pagewidth printbar by providing end-to-end abutment of fully functional printhead elements (die modules) on a substrate. This type of arrangement is termed buttable or butted. In other words, each of the die modules are positioned joined end to end with respect to each other such that the die modules together make up the print region of the print medium. The die modules are positioned end to end so that the pixels produced by from neighboring modules show no seams, and the pixels appear to be produced by one continuous line of uniformly spaced ink drop nozzles. U.S. Pat. Nos. 5,192,959, 4,999,077, and 5,198,054 disclose processes for forming linear printbars of butted subunits.

Because each of the die modules are positioned joined end to end with respect to each other on a single substrate such that the die modules together make up the print region of the print medium, only one full width printbar is necessary, for example, with a black ink only system. Additional full-width color printbars may be added to enable a highlight or full color printer.

In a multi-color ink jet printing process, several full-width array printbars are used in a printer to deposit different color inks onto a print medium to give full color images. The different color inks comprise, for example, black, cyan, magenta, and yellow inks.

U.S. Pat. Nos. 5,280,308, 5,343,227, and 5,270,738 disclose full color pagewidth printers with four printbars, black, cyan, magenta, and yellow; and U.S. Pat. Nos. 5,192,959, 4,999,077, and 5,198,054 disclose processes for forming linear printbars of butted subunits.

However, in a full-width array printbar with die modules abutted end to end, the joints between successive die modules make it difficult to accurately and precisely print on a print medium. For example, one configuration includes a number of die modules 12 butted together on a substrate 14, as shown in FIGS. 1 and 2. However, in a full-width array printbar with die modules butted end to end, the butting requires very tight tolerances in dicing at placing the die module on the substrate. If these tolerances are not met, streaks may result when printing. Further, in a full-width array printbar 10 with die modules 12 butted end to end, the end jets of the die modules tend to behave differently than those in the middle of the array. Specifically, streaks can result, even with perfect dicing and placement. Thus, butting of the die modules has the disadvantage of inducing end-jet defects.

Another method for fabricating a full-width printbar is to provide same color die modules as two separated printbars. This type of arrangement is referred to as nonbuttable as the die modules of the printbars are not abutting each other. Die modules of the first printbar are spaced substantially evenly apart, creating a gap between each of the die modules. Die modules of the same output color are then located on the second printbar in a spaced apart manner such that they align with the gaps between the die modules on the first printbar. The die modules of the two printbars thus overlap so that the die modules of the two printbars together make up the print region of the print medium, as shown in FIG. 3. The die modules 12 of the first printbar 16 are spaced substantially evenly apart on the first substrate 18 creating gaps 20 between each of the die modules 12. Die modules 12 of the second printbar 17 are also spaced substantially evenly apart on the second substrate 22, but are spaced such that they cover the gaps 20 between the die modules 12 on the first substrate 18. The die modules 12 of the two printbars 16 and 17 overlap.

In other words, the die modules 12 of the two printbars 16 and 17 are staggered to form a checker board pattern, but also overlap each other. For this arrangement, two printbars are required for each color to be printed. Thus, for a four-color printer, for example, eight printbars on eight substrates are required.

With respect to the configuration illustrated in FIG. 3, the problems associated with streaking and end-jet defects as discussed above is addressed. However, using two substrates 18 and 22 for each set of same color die modules 12 is space consuming.

Alternatively, in order to reduce the space required for the nonbuttable array that requires two printbars 16 and 17 for each color and uses two substrates 18 and 22 as in FIG. 3, the die modules of one color printbar may be mounted on one side of a substrate and one or more die modules of the associated same color printbar maybe be mounted on an opposite side of the substrate. The die modules of the same color output may thus be staggered on opposite sides of a single substrate as shown in FIG. 4. Here, die modules 26 are right side up on one surface 28 of a substrate 30 and die modules 32 are upside down on an opposite surface 34 of the substrate 30. Thus, fewer substrates, namely half (or four substrates for a four color printer) are required. Such an alternative is disclosed in U.S. Pat. No. 5,257,043 to Kneezel, which is hereby incorporated by reference in its entirety.

However, in the ink jet printer disclosed by Kneezel, as ink is dispersed from the right side up die modules and ink is also dispersed from the upside down die modules, different intensity, brightness, tone, volume, and/or the like of the color ink may result, leading to color distortion.

Thus, a more compact full-width array printer with improved print quality is needed.

A further consideration when designing a pagewidth color printer is the cost and maintenance of the full-width printbars. Reducing the number of required substrates in a printhead would result in fewer parts and less maintenance.

A more compact printer that does not detract from the integrity of the ink printout is needed.

SUMMARY OF THE INVENTION

There is a need for a more compact nonbuttable full-width array color printer.

There is also a need to increase the speed of color printers without detracting from the color integrity or uniformity of the image printed.

There is a need for a color printer with nonbuttable full-width array printbars with enhanced colors for printed color images and having a fuller range of colors.

The above and other advantages are achieved by various embodiments of the invention.

In exemplary embodiments, fewer printbars are required for a more compact printer structure.

In exemplary embodiments, the configuration of the printbars may provide enhanced color images.

In exemplary embodiments, the configuration of the printbars may provide greater uniformity of colors.

In exemplary embodiments, the configuration of the printbars may provide greater integrity of colors.

DETAILED DESCRIPTION OF PREFERRED EMBODIMENTS

As used herein, the term "printbar" is used to refer to a single row of a plurality of substantially aligned die modules. The row of die modules is preferably substantially aligned with respect to a line parallel with a top edge of a print medium to be printed upon, i.e., aligned across the width of the print medium. Each of the substantially aligned die modules of a printbar are typically mounted upon a substrate. The substrate for a single printbar may either be continuous or discontinuous.

Figure 7:
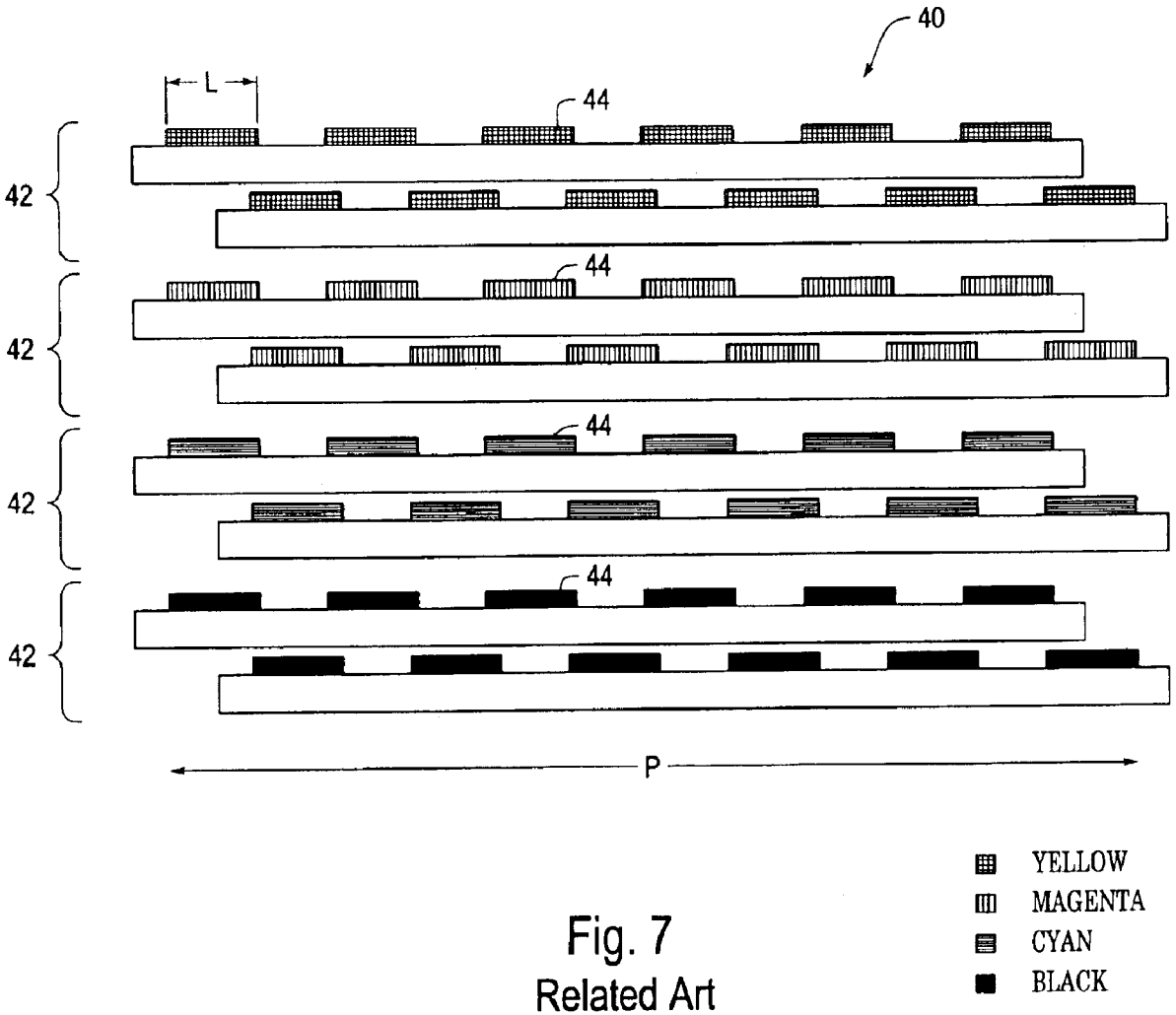
Fig. 7 Related Art
FIG. 7 illustrates an eight printbar configuration in a four-color nonbuttable full-width array printer based on the separate substrate design of FIG. 2.

FIG. 7 shows an existing typical printhead configuration 40 for a four-color nonbuttable full-width array printer. There are two halfbars 42 for each of the four colors, cyan (C), magenta (M), yellow (Y) and black (K) for a total of eight halfbars 42. There are six die modules 44 for each of the halfbars 42, or twelve die modules 44 for each color. The total allowable printing length P is printed using the two complementary staggered halfbars 44 for each color.

Although two complementary printbars for each of the four colors, or eight printbars in total (each on its own substrate), is commonly used, an additional set of two printbars, each mounted on respective substrates, for each of possible additional colors, such as, for example, light cyan or light magenta, may be added. Thus, the total number of printbars and substrates may be greater than eight, for example, twelve, or the like. In the configuration of FIG. 7, the total number of printbars and substrates required is always twice the number of colors to be printed.

An advantage of the configuration of the present invention is that the total number of substrates employed is equal to the number of colors to be printed. Specifically, where X represents the total number of colors that can be applied by the printhead, the total number of substrates Y of the printhead in the present invention satisfies the relationship X=Y.

Further, the printhead further comprises at least one ink supply line for each of the X number of different colors that supply a colored ink to the die modules that print that colored ink.

Figure 4:
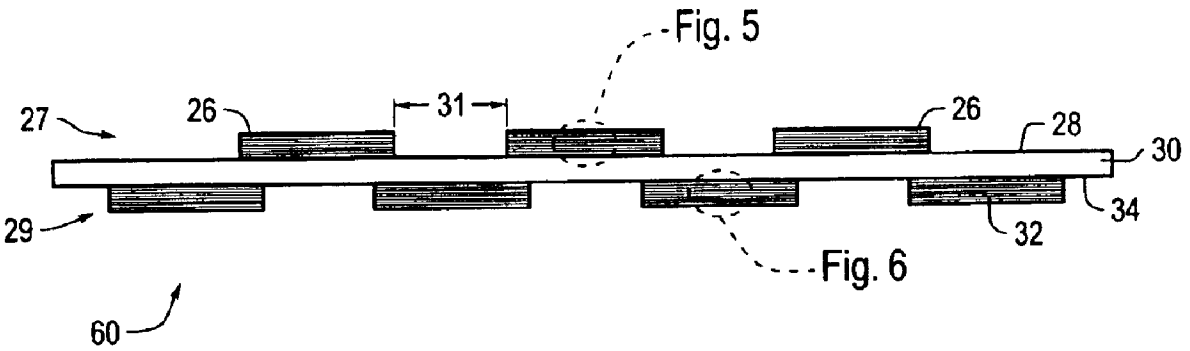
Fig. 4 Related Art
FIGS. 4–6 illustrate staggered same color output die modules on both sides of one full-width array printbar.
Figure 6:
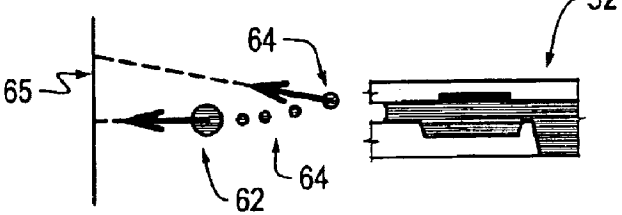
Fig. 6 Related Art
Figure 5:
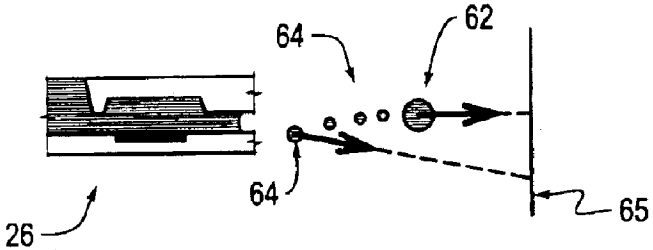
Fig. 5 Related Art

Referring to FIGS. 4–6, one set of associated printbars, for example, for outputting or applying the color magenta, is illustrated (i.e., a set of two printbars for magenta 60). The die modules 26 and 32 of the printbars for magenta 60 illustrated in FIG. 4 are located on both sides of the substrate 30. Right side up die modules 26 of a first printbar 27 for magenta 60 are mounted on a top surface 28 of the substrate 30 and upside down die modules 32 for a second associated printbar 29 for magenta 60 are mounted on a bottom surface 34 of the substrate 30. The right side up die modules 26 on the top side 28 of the substrate 30 are substantially evenly spaced across the substrate 30 creating gaps 31 between each of the right side up die modules 26. The upside down die modules 32 on the bottom surface 34 of the substrate 30 are substantially evenly spaced apart from each other and are offset from the right side up die modules 26 on the top surface 28 of the substrate 30 in order to be in vertical alignment with the respective gaps 31 with the printing segments of that color on the top surface 28 of the substrate 30.

For example, the first printbar 27 for magenta 60 has three magenta colored die modules 26 spaced substantially evenly apart located on the top surface 28 of the substrate 30. The associated second printbar 29 for magenta 60 has four magenta colored die modules 32 spaced substantially evenly apart located on the bottom surface 34 of the substrate 30. The evenly spaced die modules 26 on the top surface 28 of the substrate 30 are vertically aligned with the gaps 31 exposed on the bottom surface 34 of the substrate 30. The complementary sets of same output color die modules on each surface of the common substrate are thus aligned so as to cover the gaps between die modules of the associated printbar on the opposite surface of the substrate.

Figure 1:
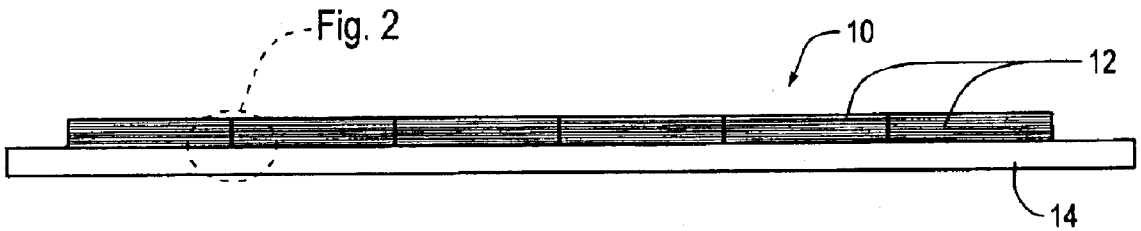
Fig. 1 Related Art
FIGS. 1 and 2 illustrate a full-width array printbar with die modules butted end to end.
Figure 2:
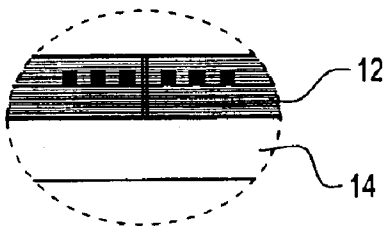
Figure 3:
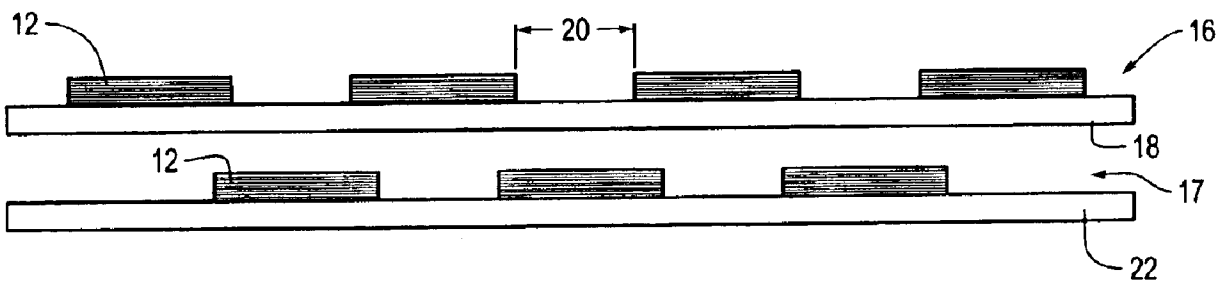
Fig. 3 Related Art
FIG. 3 illustrates two full-width array printbars with staggered die modules that overlap on separate substrates.

As shown in FIG. 4, because same output color die modules 26 and 32 are provided on both sides of the substrate 30, fewer substrates are required as compared to the printhead design of FIGS. 3 and 7. For example, for a four color printer, only four substrates would be required compared to the eight substrates required for the printhead illustrated in FIG. 7.

Referring to FIGS. 5 and 6, as ink from the die modules 26 and 32 is discharged, a main drop 62 followed by satellite drops 64 are transferred to a print medium 65. Ideally, the satellite drops 64 of ink land on top of the main drop 62. However, due to asymmetry of the drop ejector, the satellite drops 64 are typically ejected at a slightly different angle and speed than the main drops 62. As the print media is moved past the printbars, the satellite drops tend to land substantially on top of the main drops for one configuration (e.g. the right side up die modules 26), but tend to land farther from the main drop for the other configuration (e.g. the upside down die modules 32). Thus, as ink, for example, in the color of cyan, is dispersed from the right side up die modules 26 and the cyan color ink is also dispersed from the upside down die modules 32, different intensity, brightness, tone, volume, and/or the like of the cyan color ink results, leading to color distortion.

In an embodiment of the present invention, the configuration of the printbars is varied to improve the resulting print quality. More specifically, the printbars mounted on the substrates are configured such that all die modules for applying a specific color are either upside down or right side up, but not both.

Figure 8:
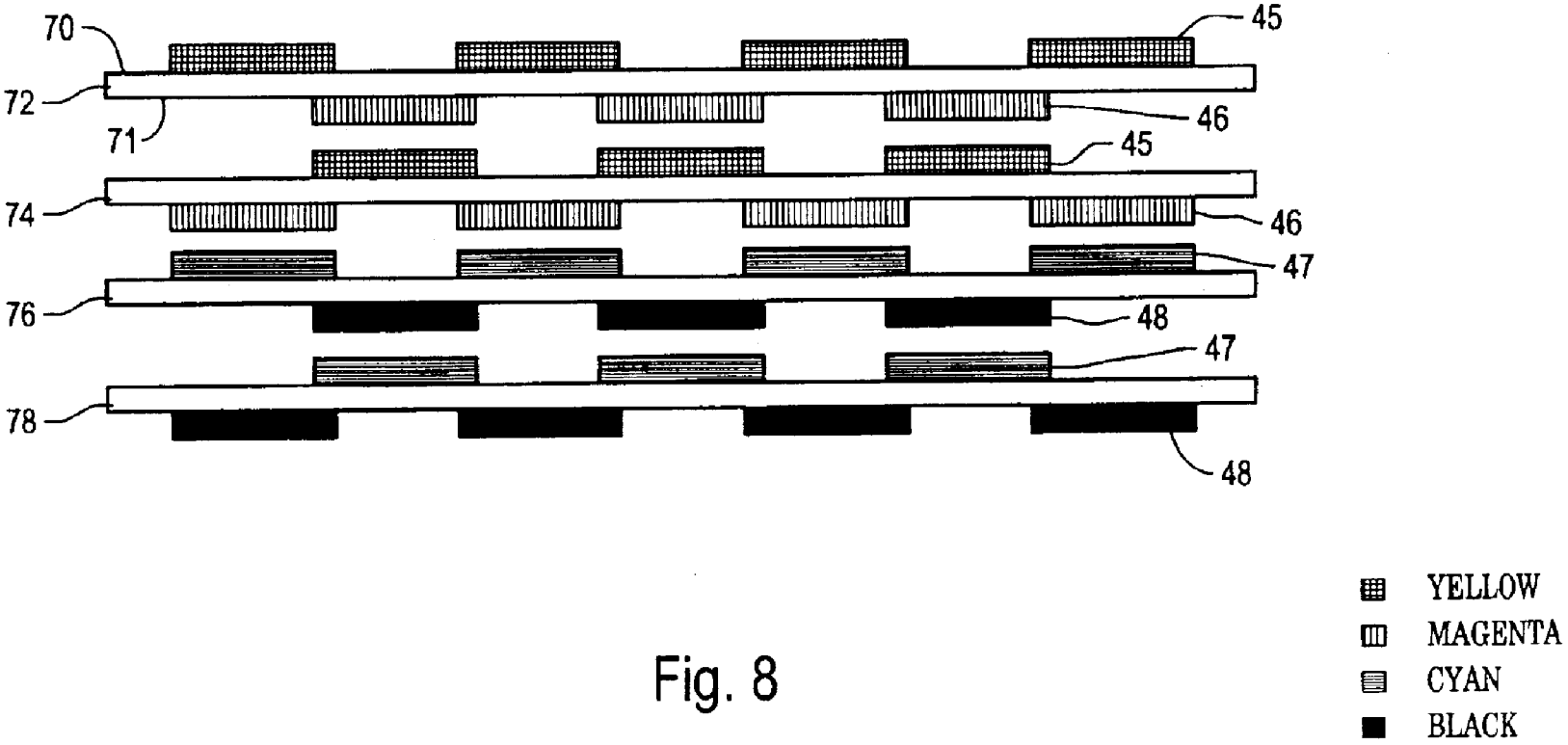
FIGS. 8–10 illustrate embodiments of an eight printbar configuration with staggered die modules of different output colors on either side of a common substrate for a four-color nonbuttable full-width array printer.

A first embodiment of the invention is shown in FIG. 8, wherein die modules 45, 46, 47 and 48 are staggered on both sides of a first substrate 72, and second substrate 74, a third substrate 76 and/or a fourth substrate 78. In particularly, one surface 70 (i.e., top surface) of the first substrate 72 has die modules 45 for outputting a first ink color and the opposite surface 71 (i.e., bottom surface) of the first substrate 72 has die modules 46 for outputting a different, second color. Here, die modules 45, for outputting yellow ink/toner, are on the top surface 70 of the first substrate 72 and die modules 46 for outputting magenta ink/toner are located on the bottom surface 71 of the first substrate 72. The next adjacent substrate (i.e., the second substrate 74) below the first substrate 72 includes the same color die modules on the top and bottom surfaces as the first substrate 72, i.e., yellow die modules 45 on the top and magenta die modules 46 on the bottom. Here, each of the die modules on this second substrate 74 are staggered with respect to the corresponding same color die modules on the first substrate 72. That is, the die modules on the first substrate are aligned with the gaps between die modules that output the same color on the second substrate.

Further, the top surface 70 of the third substrate 76 has die modules 47 with one ink color and the bottom surface 71 of the third substrate 76 has die modules 48 for outputting a different, second color. Here, die modules 47, for outputting cyan ink/toner, are on the top surface 70 of the third substrate 76 and die modules 48 for outputting black ink/toner are located on the bottom surface 71 of the third substrate 76. The next adjacent substrate (i.e., the fourth substrate 78) below the third substrate 76 includes the same color die modules on the top and bottom surfaces as the third substrate 76, i.e., cyan die modules 47 on the top and black die modules 48 on the bottom. Here, each of the die modules on this fourth substrate 78 are staggered with respect to the corresponding same color die modules on the third substrate 76.

In such a configuration, all of the yellow die modules 45 and cyan die modules 47, for example, are located right side up, on the top surface of respective substrates. Thus, the relative location of the discharged main drop 62 and satellite drops 64 may be substantially uniform across the printed page for the yellow and cyan dies. Likewise, all of the magenta die modules 46 and black color die modules 48 are located up side down, on the bottom surface of respective substrates. Thus, the relative location of the discharged main drop 62 and satellite drops 64 may be substantially uniform across the printed page for the magenta and black dies.

Further, with the printbars illustrated in FIG. 8, the size of the die modules is slightly larger than that of the gaps so that there can be some printing overlap at the stitches between die modules. Satellite-related banding is eliminated because all the die modules of a particular color are oriented in the same way. Furthermore, the configuration is very compact because it avoids having two separate substrates per color.

Figure 9:
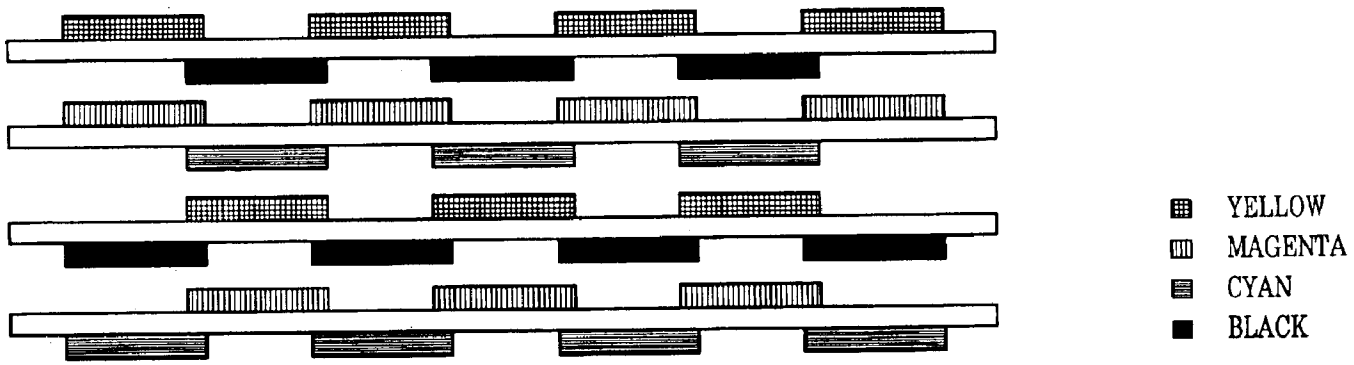
Figure 10:
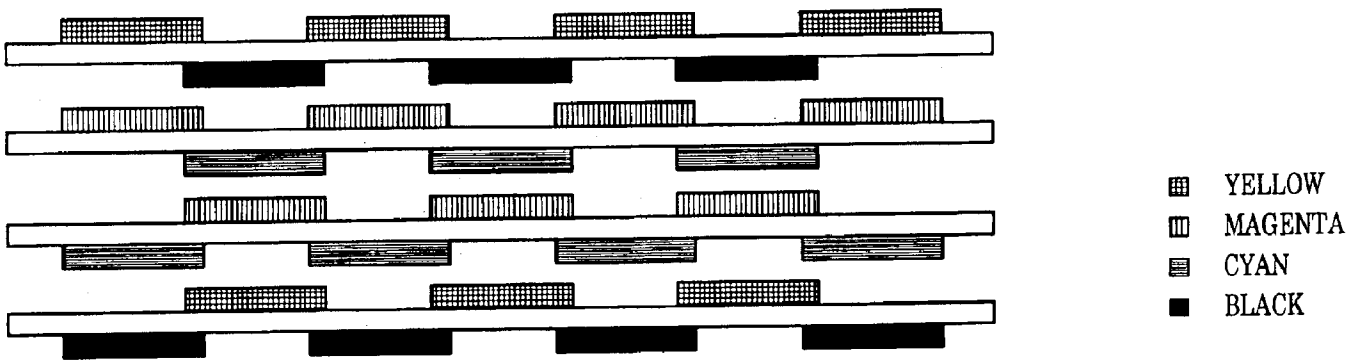

Other embodiments of this concept showing different orientations of the colors black, yellow, magenta and cyan are shown in FIGS. 9 and 10. In particular, as shown by comparing FIGS. 8 and 9, the die modules having different colors do not have to be oriented in the same exact order (i.e., FIG. 8 illustrates the colors yellow, magenta, cyan and black, in that order, whereas FIG. 9 illustrates yellow, black, magenta and cyan, in that order). Still further, by comparing FIGS. 8 and 9 with FIG. 10, it can be seen that substrates with corresponding colors may or may not be adjacent. Specifically, printbars having die modules with identical colors do not need to be located in adjacent substrates, as shown in FIGS. 8 and 9. Rather, as shown in FIG. 10, the two associated printbars may be located on any substrate, in any order, so long as the set of two associated same color printbars for all colors are on the same surface (i.e., top surface or bottom surface, but not both) of different substrates and the die modules of the two associated printbars are properly staggered.

The yellow and magenta die modules may both be used to print a color red. Referring to FIG. 8, on one side 70 of the first substrate 72, the printbar for yellow would print before the printbar for magenta for regions corresponding to where the single-color yellow die modules are directly horizontally aligned with portions of the single-color magenta die modules. However, on an opposite side 71 of the first substrate 72, in regions corresponding to the gap between single-color yellow die modules, magenta would be printed first before the yellow is printed. Printing yellow first followed by printing magenta may yield a different color, different intensity, different tone, or the like than printing magenta first followed by printing yellow. Thus, colors throughout the printed image may not be uniform and may appear to be distorted. It is acceptable for some print applications to have slight color distortion. In such cases, the color distortion is not readily apparent to the naked eye. However, in higher print quality applications, a better color print quality may be desired.

In another embodiment of the present invention, the configuration of the printbars on the substrates is varied to improve the resulting print quality. The print quality is improved by preserving the order in which ink is deposited across the page. More specifically, as paper moves past the set of printbars, the color order will be the same across the page.

Figure 11:
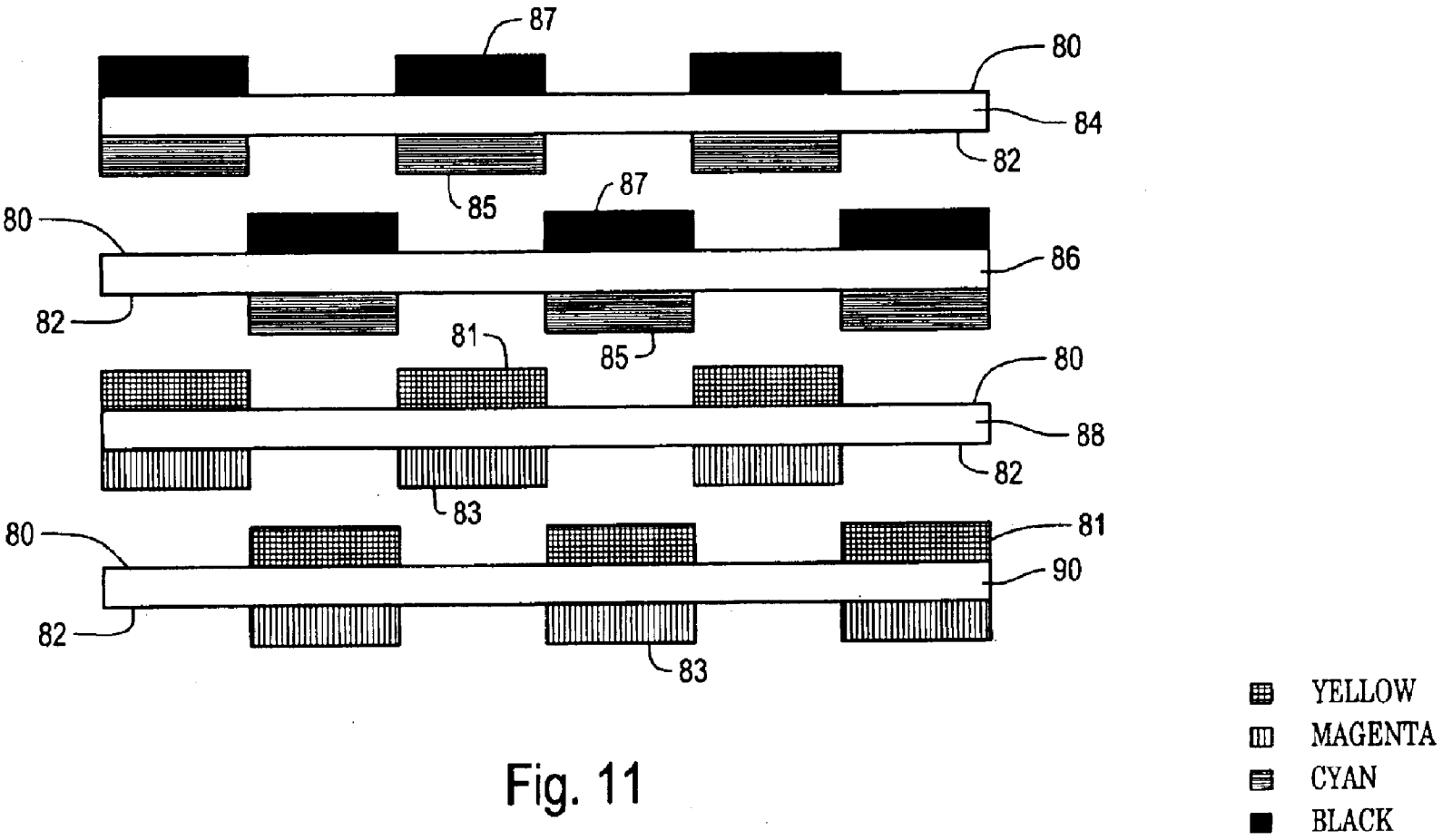
FIG. 11 illustrates an eight printbar configuration with die modules of different output colors on either side of a common substrate for a four-color nonbuttable full-width array printer.

FIG. 11 represents a preferred embodiment because it preserves color print order, providing superior uniformity with a compact design. Specifically, the die modules are located on both sides, at the same location, across the width of the substrate, as opposed to locating each in gap regions of each other on opposite sides of the substrates as shown in FIGS. 8–10.

Referring to FIG. 11, a printbar configuration is provided in which colors are printed in one order only to avoid color distortion and provide for color uniformity. As discussed above, die modules 81, 83, 85 and 87, for example, are located on a top surface 80 and a bottom surface 82 of a substrate 84, 86, 88 and 90 in order to reduce the total amount of substrates required in a color printer. Referring, for example, to the substrates 88 and 90, yellow die modules 81 are shown on the top surface 80 of each of the substrates 88 and 90. Magenta die modules 83 are shown on the bottom surface 82 of each of the substrates 88 and 90.

Because die modules of the printbars for each of the colors is located either up side down or right sight up, but not both, the issue of distortion of color due to offset satellite drops of ink is addressed. Further, the colored ink will be printed in a specific order such that color distortion will be avoided.

For example, as discussed above, to print the color red, the yellow and the magenta die modules are used. In this case in any location on the printing region for each die module, yellow will always be printed first, and then magenta. Of course, any number of colors may be added to this embodiment. For example, in a six color printer with reduced number of substrates in an embodiment of this invention, six substrates may be provided. Further, any color order may be used as long as the location of the color (either on the top surface or bottom surface of the substrate, but not both) is consistent.

Figure 12:
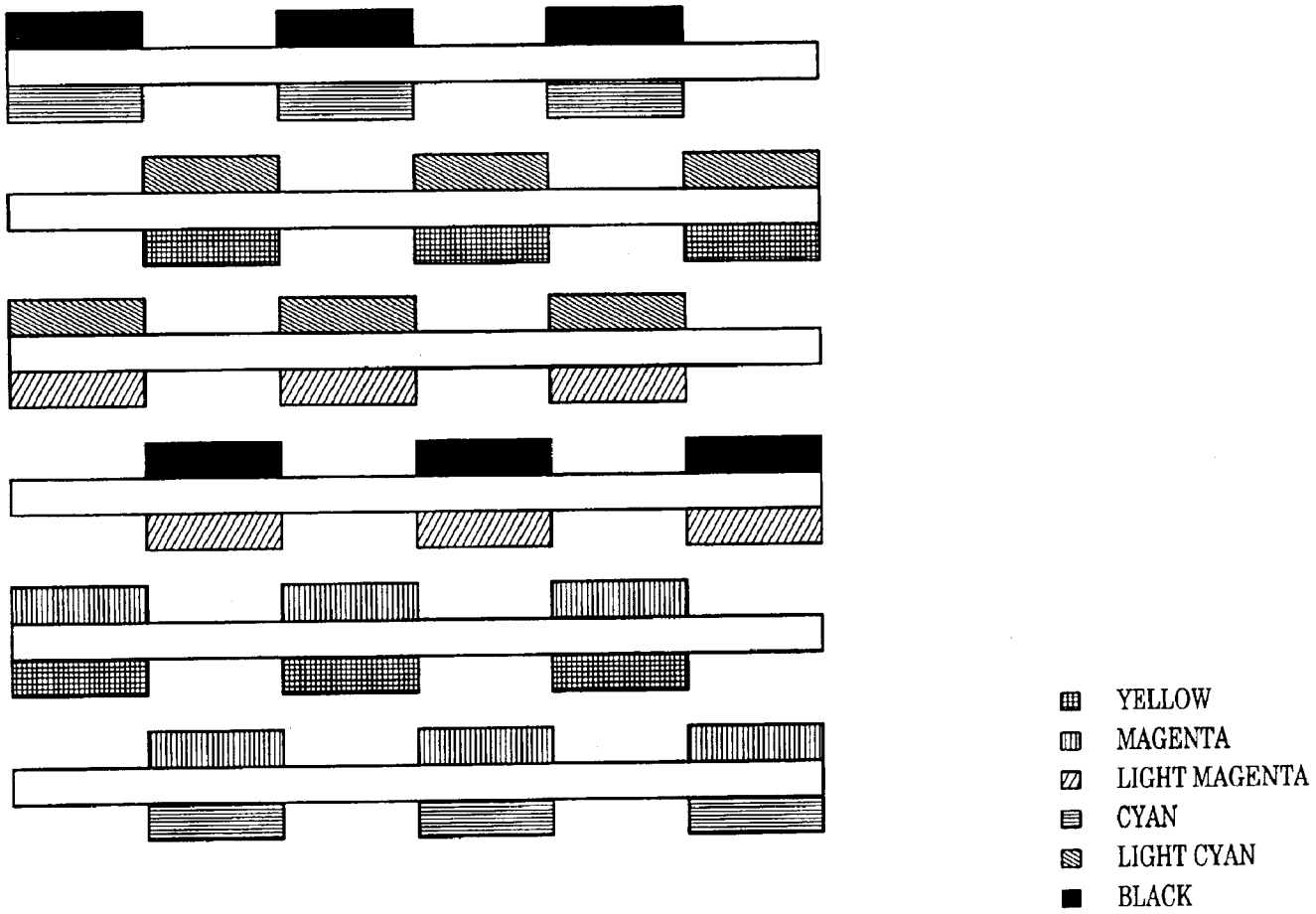
FIG. 12 illustrates a twelve printbar configuration with die modules of different output colors on either side of a common substrate for a six-color nonbuttable full-width array printer.
Figure 13:
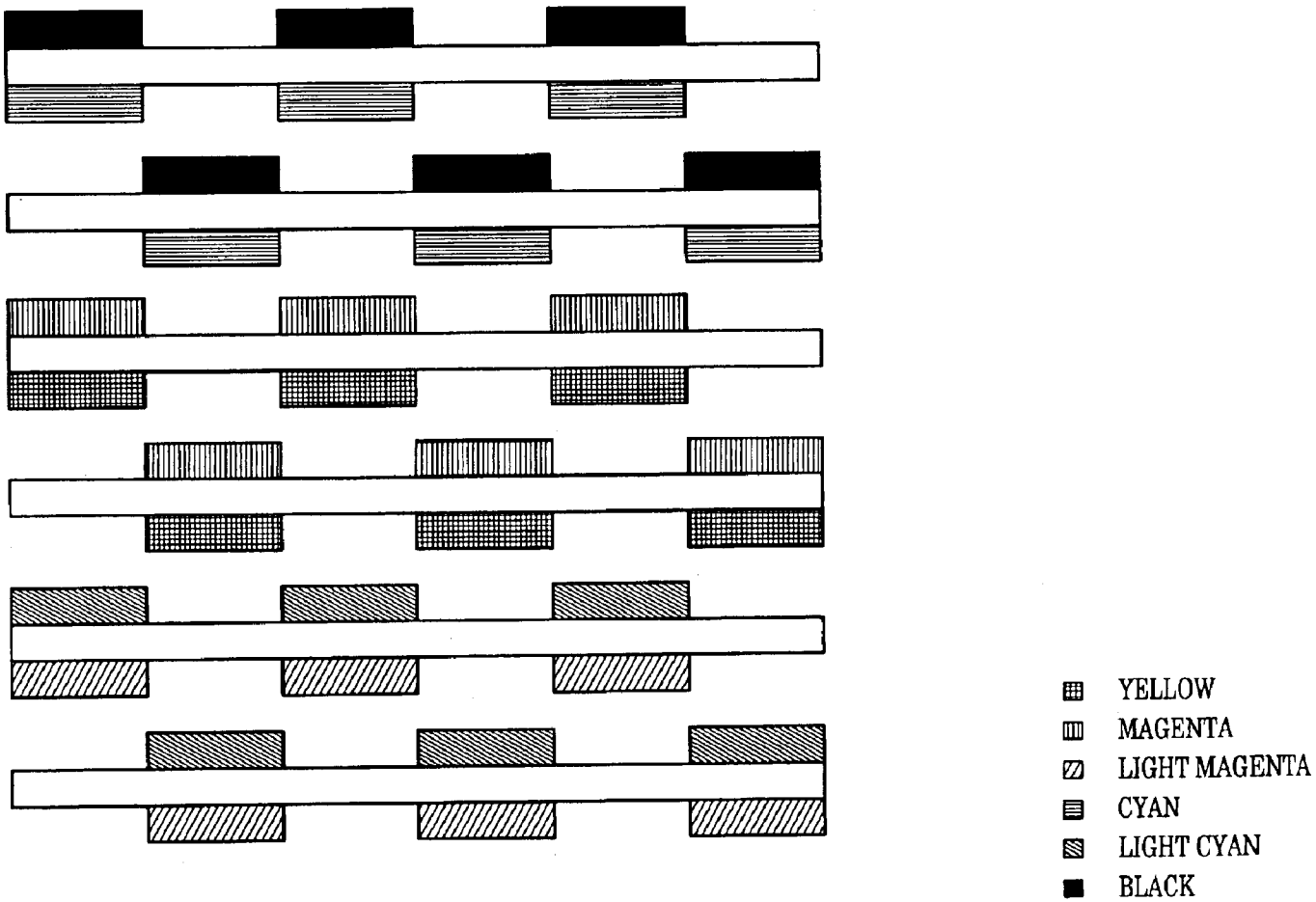
FIG. 13 illustrates another twelve printbar configuration with die modules of different output colors on either side of a common substrate for a six-color nonbuttable full-width array printer.

Referring to FIGS. 12 and 13, the embodiments of the present invention may include a color printer capable of printing with more than four colors of ink. For example, a printer may use a printhead including printbars having die modules for outputting "light cyan" ink and "light magenta" ink in addition to the standard yellow (Y), cyan (C), magenta (M) and black (K) ink. A typical printer including these six colors would require twelve halfbars for the six colors. The present invention could, for example, reduce the required number of substrates for a standard six color printer from twelve substrates to as low as 6 substrates. As discussed in detail above, two associated printbars (having die modules outputting the same color ink/toner) may be located on any substrate, in any order, so long as the set of two associated same color printbars for all colors are on the same surface (i.e., top surface or bottom surface, but not both) of different substrates and the die modules of the two associated printbars are properly staggered.

It is envisioned that the embodiments of the present invention may include any number of variations in printbars, such as, for example, printbars with die modules of varying colors, printbars that disperse ink in volumes of varying amounts to effect a better range in colors, and the like.

Further, the described embodiments may be used with any number of printers including thermal ink jet printers and the like. The described embodiments may be used with copiers, facsimile machines, or any equipment in which multiple colors are being printed.

Those skilled in the art will recognize that certain variations and/or additions can be made in these illustrative embodiments. It is apparent that various alternatives and modifications to the embodiments can be made thereto. It is, therefore, the intention in the appended claims to cover all such modifications and alternatives as may fall within the true scope of the invention.

What is clamed is:

1. A full-width array printhead comprising:

a first printbar comprised of a plurality of first die modules, for applying a first color, spaced substantially evenly apart so as to have gaps between each die module and located on a top surface of a first substrate, a second printbar comprised of a plurality of second die modules, for applying a second color, different from the first color, spaced substantially evenly apart so as to have gaps between each die module and located on a bottom surface of the first substrate, a third printbar comprised of a plurality of third die modules, spaced substantially evenly apart, on a top surface of a second substrate, wherein each of the plurality of third die modules is aligned with respect to the first die modules such that each substantially covers a gap between the first die modules; and a fourth printbar comprised of a plurality of fourth die modules, spaced substantially evenly apart, on a bottom surface of the second substrate, wherein each of the plurality of fourth die modules is aligned with respect to the second die modules such that each substantially covers a gap between the second die modules.

2. The full-width array printhead of claim 1, wherein the third die modules and the first die modules both apply the same first color and/or the fourth color die modules and the second die modules both apply the same second color.

3. The full-width array printhead of claim 1, wherein the first substrate and the second substrate are vertically adjacent with no additional substrate there between.

4. The full-width array printhead of claim 1, wherein the first substrate and the second substrate are vertically spaced apart such that one or more additional substrates with die modules thereon are between the first and second substrates.

5. The full-width array printhead of claim 4, wherein the one or more additional substrates each comprise a printbar comprised of a plurality of die modules on each of a top surface and a bottom surface thereof.

6. The full-width array printhead of claim 1, further comprising:

a left edge of the plurality of first die modules; and a right edge of the plurality of second die modules, wherein a print region extends from the farthest left edge of the plurality of first die modules to the farthest right edge of the plurality of second die modules.

7. The full-width array printhead of claim 1, further comprising:

a fifth printbar comprised of a plurality of fifth die modules, for applying a third color, different from the first and second color, spaced substantially evenly apart so as to have gaps between each die module and located on a top surface of a third substrate, a sixth printbar comprised of a plurality of sixth die modules, for applying a fourth color, different from the first color, second color and third color, spaced substantially evenly apart so as to have gaps between each die module and located on a bottom surface of the third substrate, a seventh printbar comprised of a plurality of seventh die modules, spaced substantially evenly apart, on a top surface of a fourth substrate, wherein each of the plurality of seventh die modules is aligned with respect to the fifth die modules such that each substantially covers a gap between the fifth die modules; and an eighth printbar comprised of a plurality of eighth die modules, spaced substantially evenly apart, on a bottom surface of the fourth substrate, wherein each of the plurality of eighth die modules is aligned with respect to the sixth die modules such that each substantially covers a gap between the sixth die modules.

8. The full-width array printhead of claim 7, wherein the fifth die modules and the seventh die modules both apply the same third color and/or the sixth color die modules and the eighth die modules both apply the same fourth color.

9. The full-width array printhead of claim 7, wherein the first die modules and the fifth die modules both apply the same first color or third color and/or the second color die modules and the sixth die modules both apply the same second or fourth color.

10. The full-width array printhead of claim 7, wherein the first die modules and the seventh die modules both apply the same first color and/or the second color die modules and the eighth die modules both apply the same second color.

11. The full-width array printhead of claim 7, wherein the third die modules and the seventh die modules both apply the same first color or third color and/or the fourth color die modules and the eighth die modules both apply the same second color or fourth color.

12. The full-width array printhead of claim 7, wherein the first substrate, the second substrate, the third substrate and the fourth substrate are vertically adjacent to each other in any order.

13. The full-width array printhead of claim 7, further comprising:

a ninth printbar comprised of a plurality of ninth die modules, for applying a fifth color, different from the first color, second color, third color and fourth color, spaced substantially evenly apart so as to have gaps between each die module and located on a top surface of a fifth substrate, a tenth printbar comprised of a plurality of tenth die modules, for applying a sixth color, different from the first color, second color, third color, fourth color and fifth color spaced substantially evenly apart so as to have gaps between each die module and located on a bottom surface of the fifth substrate, an eleventh printbar comprised of a plurality of eleventh die modules, spaced substantially evenly apart, on a top surface of a sixth substrate, wherein each of the plurality of eleventh die modules is aligned with respect to the ninth die modules such that each substantially covers a gap between the ninth die modules; and a twelfth printbar comprised of a plurality of twelfth die modules, spaced substantially evenly apart, on a bottom surface of the sixth substrate, wherein each of the plurality of twelfth die modules is aligned with respect to the tenth die modules such that each substantially covers a gap between the tenth die modules.

14. The full-width array printhead of claim 1, wherein the gaps between each of the plurality of first die modules of the first printbar are vertically aligned with the gaps between each of the plurality of second die modules of the second printbar and wherein the gaps between each of the plurality of third die modules of the third printbar are vertically aligned with the gaps between each of the plurality of fourth die modules of the fourth printbar.

15. The full-width array printhead of claim 1, wherein the gaps of the first printbar are vertically aligned with the gaps of the third printbar and the gaps of the second printbar are aligned with the gaps of the fourth printbar and further wherein the gaps on the second printbar and fourth printbar are not aligned with the gaps on the first printbar and/or the third printbar.

16. A nonbuttable printhead comprising a set of printbars, each printbar comprised of a row of a plurality of nonbuttable die modules in substantial alignment, the set of printbars including a total number of substrates (Y) equal to a total number of different colors (X) capable of being applied by the printhead, wherein a first printbar of the plurality of printbars having a first color of the total number of different colors (X) is located on a top surface of a first substrate and a second printbar of the plurality of printbars having a second color of the total number of different colors (X) is located on a bottom surface of the first substrate.

17. The printhead of claim 16, wherein the total number of substrates is two for a printhead that applies two different colors.

18. The printhead of claim 16, further comprising:

a third printbar of the plurality of printbars having the first color of the total number of different colors (X) located on a top surface of a second substrate and a fourth printbar of the plurality of printbars having the second color of the total number of different colors (X) located on a bottom surface of the second substrate.

19. The printhead of claim 18, further comprising:

gaps between the plurality of nonbuttable die modules in substantial alignment on the top surface of the first substrate of the first printbar, wherein the plurality of nonbuttable die modules on the top surface of the second substrate of the third printbar are vertically aligned with the gaps on the top surface of the first substrate; and gaps between the plurality of nonbuttable dic modules in substantial alignment on the bottom surface of the first substrate of the second printbar, wherein the plurality of nonbuttable die modules on the bottom surface of the second substrate of the fourth printbar are vertically aligned with the gaps on the bottom surface of the first substrate.

20. The printhead of claim 18, wherein the row of the plurality of nonbuttable die modules mounted on the top surface of the first substrate is in substantial vertical alignment with the row of the plurality of nonbuttable die modules mounted on the top surface of the second substrate such that a left edge and right edge of each of the gaps on the top surface of the first substrate is substantially vertically aligned and overlapping with a left edge and right edge of each of the die modules on the top surface of the second substrate.

* * * * *